US009555458B2

(12) United States Patent
Blei

(10) Patent No.: US 9,555,458 B2
(45) Date of Patent: Jan. 31, 2017

(54) IRONING RING HAVING A MICROSTRUCTURE

(71) Applicant: SCHULER PRESSEN GMBH, Goeppingen (DE)

(72) Inventor: Klaus Blei, Wangen (DE)

(73) Assignee: SCHULER PRESSEN GMBH, Göppingen (DE)

( * ) Notice: Subject to any disclaimer, the term of this patent is extended or adjusted under 35 U.S.C. 154(b) by 20 days.

(21) Appl. No.: 14/851,031

(22) Filed: Sep. 11, 2015

(65) Prior Publication Data

US 2016/0001344 A1 Jan. 7, 2016

Related U.S. Application Data

(63) Continuation-in-part of application No. PCT/EP2014/054493, filed on Mar. 7, 2014.

(30) Foreign Application Priority Data

Mar. 21, 2013 (DE) ..... 10 2013 102 898

(51) Int. Cl.
*B21D 22/30* (2006.01)
*B21D 22/28* (2006.01)

(52) U.S. Cl.
CPC ..... *B21D 22/30* (2013.01); *B21D 22/28* (2013.01)

(58) Field of Classification Search
CPC ..... B21D 22/28; B21D 22/30; B21D 22/20; B21D 37/00; B21B 1/227; B21C 37/202
See application file for complete search history.

(56) References Cited

U.S. PATENT DOCUMENTS 4,040,282 A * 8/1977 Saunders ..... B21D 22/30 72/349
6,790,387 B1 * 9/2004 Ball ..... B21B 1/227 264/1.1

FOREIGN PATENT DOCUMENTS

DE 22 56 334 A1 5/1974
DE 10 2011 052773 A1 2/2013
JP H02 155520 A 6/1990
JP H10 137861 A 5/1998

OTHER PUBLICATIONS

The International Search Report of International Application No. PCT/EP2014/054493, dated May 2, 2014, the corresponding international application. (2 pages).

* cited by examiner

*Primary Examiner* — Teresa M Ekiert
(74) *Attorney, Agent, or Firm* — R. S. Lombard

(57) ABSTRACT

An ironing ring for use in a press for ironing pressing or drawing of a workpiece. The ironing ring has a work surface which, upon deforming the workpiece, contacts the workpiece, and causes flowing of the workpiece material. In order to prevent friction deposits in the region of the work surface of the ironing ring, a microstructure, differing from the roughness of the work surface, is introduced into the work surface, which forms elevations and/or recesses in the work surface. Material particles remaining on the work surface after the deforming of a workpiece thus adhere less strongly to the work surface and can be stripped off during the next deforming process.

16 Claims, 4 Drawing Sheets

IRONING RING HAVING A MICROSTRUCTURE

CROSS-REFERENCE TO RELATED APPLICATIONS

This is a continuation-in-part application of pending international application PCT/EP2014/054493 filed Mar. 7, 2014, and claiming the priority of German application No. 10 2013 102 898.5 filed Mar. 21, 2013. The said International application PCT/EP2014/054493 and German application No. 10 2013 102 898.5 are both incorporated herein by reference in their entireties as though fully set forth.

BACKGROUND OF THE INVENTION

The invention relates to an ironing ring for use in a press for ironing pressing of a workpiece.

Such ironing rings have been known per se. In a press for ironing pressing or drawing a workpiece, for example a cup, several such ironing rings are successively arranged, as a rule, in the direction of the working stroke in order to intermittently or incrementally reduce the outside diameter of the workpiece. As a result of this, it is possible, for example, to ultimately form a hollow cylindrical can body from a cup.

During the deforming process, a radially inward facing work surface of the ironing ring comes into contact with the workpiece. Depending on the material of the workpiece, more or less viscous, smeary material build-up or friction deposits occurs. This phenomenon is known. Nowadays, the ironing rings are therefore deinstalled from the press after a certain number of deforming processes, cleaned and subsequently reinstalled. This is labor-intensive and expensive and has caused the shutdown of the press.

In order to avoid friction deposits, publication DE 22 56 334 A1 discloses the possibility of applying a special lubricant to the ironing ring or the workpiece. However, such lubricants must subsequently be removed again from the deformed workpiece. This option is labor-intensive and expensive as well. Publication DE 22 56 334 A1 suggests that the ironing ring be made of ceramic material. However, if pressure is suddenly removed from the ceramic ironing ring, fissures may form, this being prevented according to DE 22 56 334 A1 in that the end region of the workpiece may immerse into a recess on the ironing stamp in order to avoid the sudden removal of pressure from the ceramic ironing ring.

Considering this, the object of the present invention may be viewed to be an ironing ring in which the risk of friction deposits is reduced and which does not require any design changes on other press components.

SUMMARY OF THE INVENTION

The invention provides an ironing ring 10 for use in a press for ironing pressing or drawing of a workpiece 11. The ironing ring 10 has a work surface 15 which, upon deforming the workpiece 11, contacts the workpiece 11 and causes flowing of the workpiece material. In order to prevent friction deposits (friction deposits) in the region of the work surface 15 of the ironing ring 10, a microstructure 22, differing from the roughness of the work surface, is introduced into the work surface 15, which forms elevations 23 and/or recesses 24 in the work surface 15. Material particles remaining on the work surface 15 after the deforming of a workpiece 11 thus adhere less strongly to the work surface 15 and can be stripped off during the next deforming process.

On its inside, the ironing ring has an interior work surface that comes into contact with the workpiece when the workpiece is being deformed. As a rule, the part of the ironing ring comprising the work surface or the entire ironing ring is made of a metallic material, in particular hard metal or tool steel. In particular on its work surface, the ironing ring is not provided with a coating and can be used without the use of lubricants. In accordance with the invention, the work surface is provided with a microstructure that includes elevations and/or recesses. These elevations and/or recesses form an uneven microstructure in the nanometer-range or micrometer range. The result of the microstructure is that, during a deforming process, particles of the deformed workpiece remaining on the work surface of the ironing ring adhere less strongly and can thus be removed easily, for example, they can be stripped off during one of the subsequent deforming processes. As a result of this, the risk of friction deposits is at least greatly reduced. In this manner, it is possible to avoid cleaning of the ironing ring or to at least drastically reduce the number of cleaning processes.

The microstructure is a form design of the work surface that is formed independently of and in addition to the roughness of the work surface. The microstructure of the work surface is directly introduced in the metallic material, in particular hard metal or tool steel, of the ironing ring. Therefore, additional coatings are not necessary. Metallic materials that are standard in ironing rings may be used. The microstructure can be produced by the defined ablation of material, for example by laser ablation.

In a few exemplary embodiments, the elevations and/or recesses of the microstructure have a regular pattern, for example due to the uniform arrangement of the elevations and/or recesses along the work surface. However, it is also possible to provide irregular microstructures, for example by varying the form, size and arrangement of elevations and/or recesses which may take place stochastically or consistent with a prespecified rule of arithmetic. A combination of regular and irregular sections or regions of the microstructure is also possible.

With a regular pattern of the microstructure, the center axes or center planes or maxima of adjacent elevations of the microstructure are preferably at the same distance. The contour of the elevations as well as the distance between the center axes or center planes or maxima, of two adjacent elevations can be defined as a function of the material of the workpiece that is to be deformed. For example, elevations may have a spherical, cylindrical or conical contour, or they may have the contour of a truncated cone, a pyramid, a truncated pyramid, a parallelepiped or a cube. Recesses of the microstructure form an intermediate space between these elevations.

Alternatively or in addition to elevations rising in the direction of the normal vector on the work surface of the ironing ring, there may also be recesses. The distance of the center axes or center planes or minima of respectively adjacent recesses of the microstructure may be the same, so that also in this case a uniformity in the microstructure is achieved.

The distance between the center axes or center planes or minima or maxima of adjacent elevations or adjacent recesses is preferably less than 50 micrometers. Depending on the material of the workpiece that is to be deformed, this distance may also be less than 1000 nanometers. Preferably, this distance is greater than 50 nanometers.

The microstructure may be embodied as a 3-dimensional or a 2.5-dimensional structure. If a three-dimensional microstructure is intended, the maximum height difference between the maxima of the elevations and the minima of the recesses measured in the direction of the normal vector on the work surface is at most 500 nanometers.

In one embodiment of the invention the elevations of the microstructure taper in the direction of the normal vector of the work surface. Therefore, the elevations have lateral flanks that are inclined relative to the normal vector on the work surface. The recess or the distance between two elevations thus increases toward the maximum or toward the free end of the elevation. As a result of this, an additional reduction of the adhesion of particles can be achieved.

An elevation and/or a recess of the microstructure, preferably measured transversely to the extension direction of the normal vector, may have in one or more dimensions a transverse dimension that is smaller than 10 micrometer and, in particular smaller than 1000 nanometers.

Preferably, the work surface has two surface sections that subtend an angle. The two surface sections are inclined relative to the longitudinal axis of the ironing ring. An ironing edge may exist in the transition region between the two surface section.

BRIEF DESCRIPTION OF THE DRAWINGS

Advantageous embodiments of the ironing ring can be inferred from the dependent claims as well as the description. The description is restricted to essential features of the invention. The drawings are to be used for supplementary reference. Hereinafter, exemplary embodiments of the invention are explained in detail with reference to the appended drawings. They show in:

DETAILED DESCRIPTION OF THE INVENTION

Figure 1:
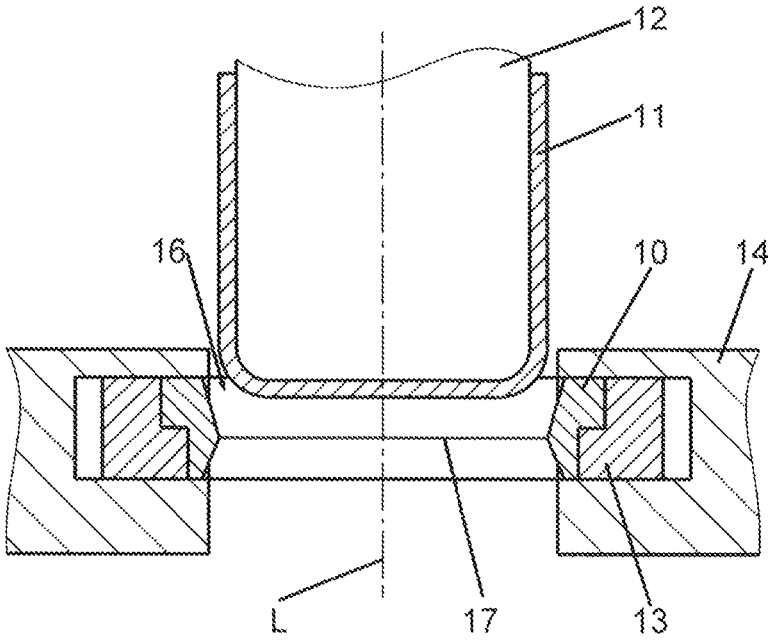
FIG. 1 a schematic representation of an ironing ring, an ironing stamp, as well as of a workpiece, in a sectional view along the longitudinal axis of the ironing ring.
Figure 2:
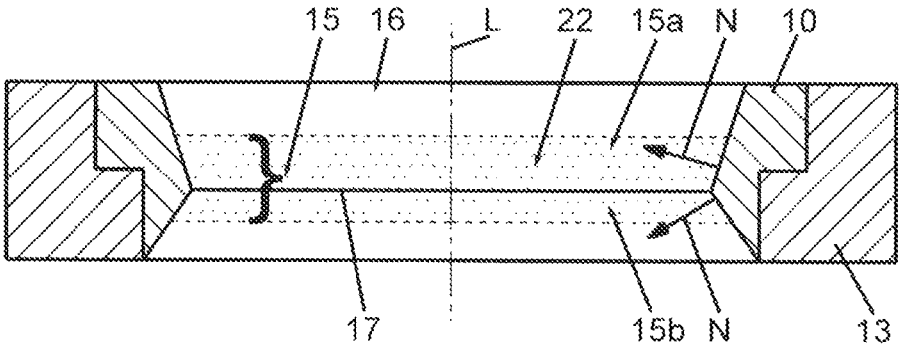
FIG. 2 a schematic sectional view of the ironing ring according to FIG. 1, along the longitudinal axis of the ironing ring; and, FIGS. 3 to 12 show a schematic diagram of elevations and/or recesses of the microstructure of the work surface of the ironing ring.
Figure 3:
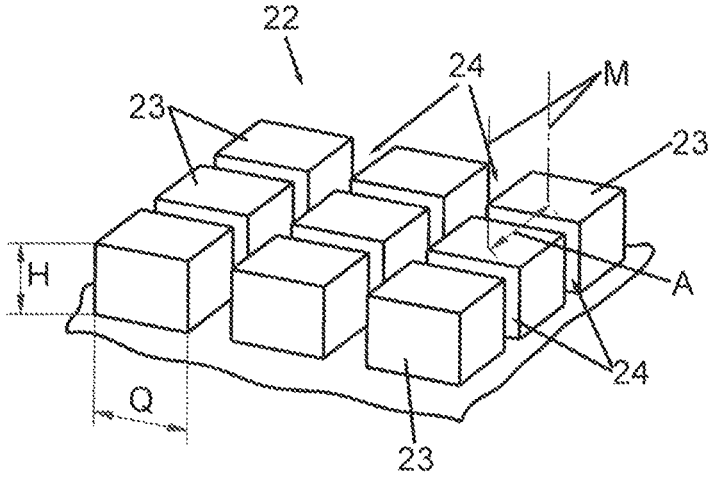

FIGS. 1 and 2 show, greatly schematized, an ironing ring 10 for ironing a workpiece 11, i.e., a cup in accordance with the example, wherein the workpiece 11 is moved with the aid of a stamp 12 through the ironing ring 10. The ironing ring 10 is supported by a ring holder 13 in a die 14 of a press that is not specifically shown in detail. By means of the press drive of the press, the stamp 12 with the workpiece 11 is pressed for deformation through the ironing ring 10. In doing so, the workpiece 11 comes into contact with a radially interior work surface 15 of the ironing ring and is thus deformed. Referring to the exemplary embodiment, the wall thickness of the workpiece 11, i.e., a cup is reduced as a result of this, whereby the length of the cup increases. Usually, considering presses for ironing drawing or ironing pressing of a workpiece 11 in a die 14, there are several ironing rings 10 arranged at distance from each other, as a result of which the deformation of the workpiece 11 takes place intermittently or incrementally.

In the exemplary embodiment, the ironing ring 10 consists of metal and, in particular, of hard metal or tool steel. About its longitudinal axis L, this ring is completely closed. The work surface 15 is arranged on the interior surface 16 of the ironing ring 10 facing the longitudinal axis L. In doing so, the work surface 15 may be a component of the interior surface 16 or be formed by the entire interior surface 16. In the exemplary embodiment, the work surface 15 has a first surface section 15*a* and a second surface section 15*b*. Both surface sections 15*a*, 15*b* are inclined relative to the longitudinal axis L and have the form of the circumferential surface of a truncated cone. At the location of transition between the two surface sections 15*a*, 15*b* there is formed an ironing edge 17 that, in modification of the schematic drawings of FIGS. 1 and 2, may also be provided with a radius. The diameter of the work surface 15 is the smallest at the ironing edge, in which case the diameter increases in the direction of the longitudinal axis L in both directions.

When ironing the workpiece 11, the work surface 15 comes into contact with the workpiece 11. Due to the friction and the pressure between the workpiece 11 and the work surface 15 it may happen that particles of the workpiece material cling to the ironing ring 11 and adhere there due to the action of the pressure between the workpiece 11 and the ironing ring 10. This process is also referred to as friction deposits. These material adhesions to the ironing ring 10 cause the form to change in the region of the work surface 15 and to thus no longer result in the desired deformation of the workpiece 11. Therefore, until now, the ironing ring 10 must be deinstalled and cleaned after a certain number of deforming processes. During this time, the press is stopped.

According to the invention such friction deposits during deformation is avoided or at least reduced. This is accomplished in that the work surface 15 and/or the entire interior surface 16 of the ironing ring 10 are provided with a microstructure 22 that is shown highly schematized in dotted lines in FIG. 2. In modification of the illustration as in FIG. 2, the microstructure 22 can also be provided on the entire interior surface 16. The microstructure 22 is directly formed in the material of the ironing ring 10. The ironing ring 10 is not provided with a coating in the region of the work surface 15 and, in particular, in the region of the entire interior surface 16. In the exemplary embodiment, the ironing ring 10 is completely made of a uniform metal material.

Figure 12:
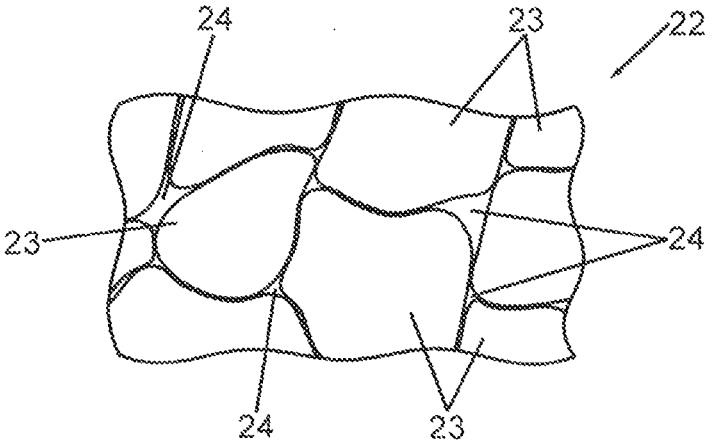

The microstructure 22 has elevations 23 and/or recesses 24, as a result of which a regular pattern of elevations 23 and thus of interspaced recesses 24 is formed in the work surface 15 of the ironing ring 10 in accordance with the example. Alternatively, it would also be possible to distribute the elevations 23 and/or the recesses 24 irregularly and, for example, stochastically, within the work surface 15, which is only shown in an exemplary manner in the schematic of FIG. 12. The microstructure 22 has the form design of the work surface 15 that is created independently of or in addition to the roughness of the work surface 15.

FIGS. 3 to 12 schematically illustrate different forms and/or exemplary embodiments of elevations 23 to produce a microstructure 22. It is also possible to use the contours or forms of these elevations 23 for the recesses 24 and, as it were, provide recesses complementary to the elevations and thus obtain a microstructure 22. Likewise, a combination of such recesses with the depicted elevations 23 is possible.

Transversely to the normal vector N relative to the work surface 15 or a surface section 15*a*, 15*b* of the work surface 15, the elevations 23 and/or recesses 24 have at least one dimension of a transverse measurement Q that, in accordance with the example, is less than 20 micrometers and, in particular, less than 1000 nanometers. In the respectively other dimension transversely to the normal vector N, the dimension of the elevation 23 or the recess 24 can be greater, in which case these may be, in particular, also so-called linear elevations 23 and recesses 24 that are configured so as be closed in a ring form around the longitudinal axis L or may end at the ends of the work surface 15—viewed in the direction of the longitudinal axis L. Such examples of linear elevations or recesses are schematically illustrated in cross-section by FIGS. 8 to 11.

Due to the microstructure 22, it is possible to avoid or at least reduce friction deposits on the work surface 15 of the ironing ring 10. When the workpiece 11 is being deformed it may happen that particles of the workpiece material remain clinging to the work surface 15 of the ironing ring 10. Due to the microstructure 22, the contact surface between such particles and the work surface 15 is reduced. Consequently, adhesion is decreased. The result of this is that, during the next deforming process, such particles located on the work surface 15 can be readily stripped off, thus clearly reducing the risk of friction deposits.

Depending on the concrete deforming task, the design and dimensioning of the microstructure 22 may vary. For example, the form and dimensioning of elevations 23 and recesses 25 is dependent on the material of which the workpiece 11 is made. In doing so, in particular the pairing of materials between the material of the ironing ring 10 and the material of the workpiece 11 must be taken into account. When cups are being ironed for the deformation of can bodies, aluminum or tinplate are frequently used, the latter also being potentially coated with plastic material, depending on the purpose of use of the can.

It is thus possible to vary the design and dimensioning of the irregularities 23, 24 of the microstructure 22. The use of linear elevations 23 or recesses 24 (FIGS. 8 to 11) as well as the use of bump-like elevations 23 or recesses 24 is possible. FIGS. 3 to 7 illustrate—only as examples—a few designs of bump-like elevations 23, between which grid-like, linear recesses 24 are provided, said recesses separating the individual elevations 23 from each other.

In the exemplary embodiment, the maximum height difference H between the maxima S or peaks of the elevations 23 and the minima G or the bottom of the recesses 24 is less than 500 nanometers. The height difference H is measured in the direction of the normal vector N on the work surface 15 or the respective work surface section 15*a*, 15*b*.

Figure 5:
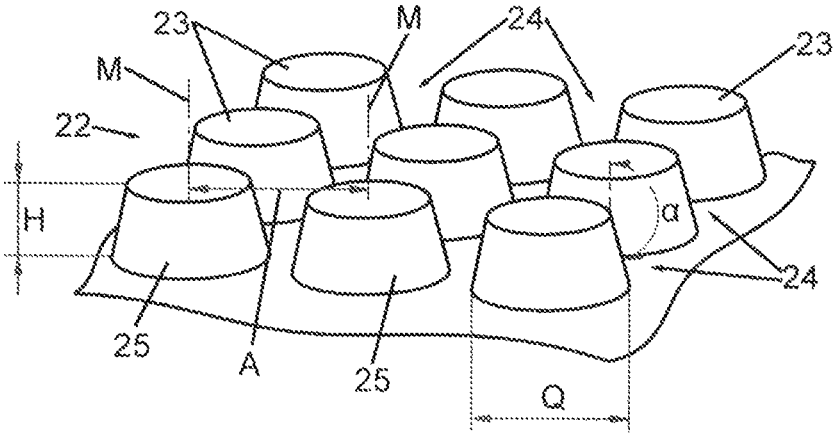
Figure 6:
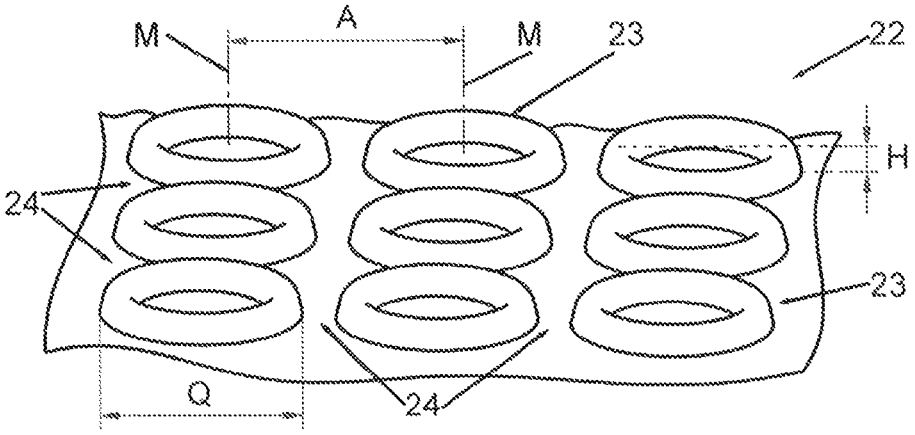
Figure 7:
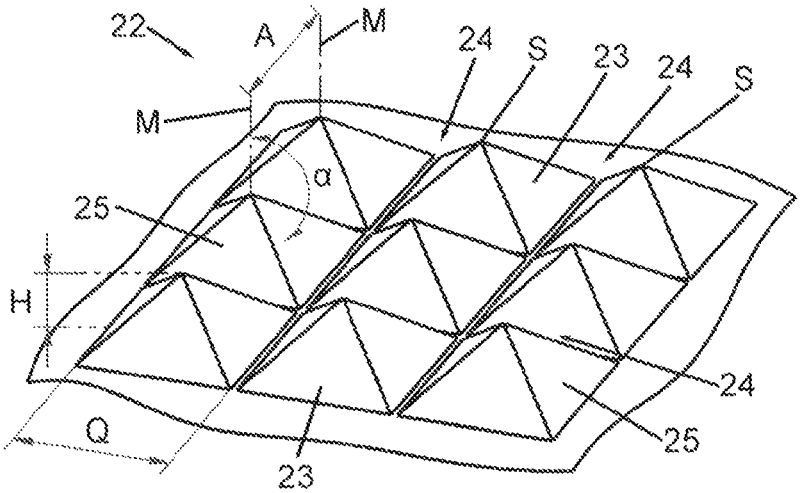

FIGS. 3 to 7 show, highly schematized, different exemplary embodiments of microstructures 22. In these exemplary embodiments, the individual elevations 23 are separated from each other by linear, groove-like recesses 24. The elevations 23 may have the form of parallelepipeds or cubes (FIG. 3), the form of a cylinder (FIG. 4), the form of a truncated cone (FIG. 5), be ring-shaped (FIG. 6) or have the form of a pyramid or tetrahedron (FIG. 7). Other forms such as, for example, honeycomb-shaped elevations 23 or spherical elevations 23 can also be used. These mentioned embodiments are only exemplary. There exists a multitude of possibilities of configuring the elevations 23. Important is that the support surface or contact surface between the material of the workpiece 11 and the ironing ring 10 is reduced, thus reducing the adhesion between a material particle of the workpiece material and the work surface 15.

Figure 4:
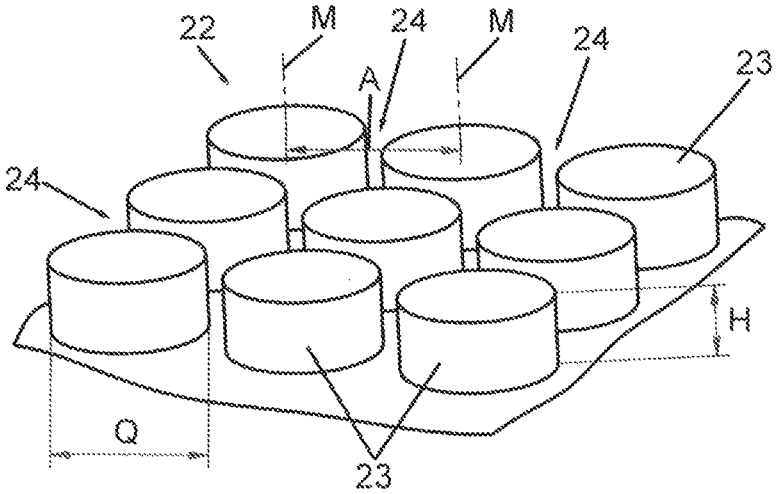

The elevations 23 may by rotation-symmetrical about their respective longitudinal center axis M (FIGS. 4 to 6). They may also taper toward their free end, this being illustrated, for example, by the form of a truncated cone in FIG. 5 and by the form of a pyramid in FIG. 7. Instead of the pyramid or tetrahedron form in FIG. 7, it would thus be possible to provide, for example, elevations 23 having the form of a truncated pyramid or a truncated tetrahedron. Considering such embodiments of the elevations 23, flanks 25 being inclined relative to the center axis M are formed. The angle of inclination a measured between such a flank 25 and the center axis M or a parallel line relative to the center axis M may be in the range of 110° to 160°.

In accordance with the example, the distance between two elevations 23 is defined between the center axes M and the center planes E, respectively, of two adjacent elevations 23. Accordingly, the distance A between two adjacent recesses 24 is defined as the distance A between their center axes M and their center planes E, respectively. If, based on the form, a center axis M or a center plane E cannot be determined at an elevation 23 or a recess 24, the distance A between two adjacent elevations 23 or two adjacent recesses 24 between the maxima S of the adjacent elevations 23 or the minima G between adjacent recesses 24 can be measured. In the case of irregular microstructures 22, it is also possible—as illustrated in an exemplary manner by FIG. 12—to determine the distance A between the centroids of the elevations 23. Accordingly, this distance determination can also be used with adjacent recesses 24.

In the exemplary embodiment, the distance A determined in one of the mentioned ways between two adjacent elevations 23 or two adjacent recesses 24 is less than 50 micrometers and, preferably, less than 1000 nanometers. Preferably, this distance A is greater than 50 nanometers.

Such microstructures 22 in the nanometer range or the micrometer range can be generated on the work surface 15 by laser ablation. For example, several laser beams may be interferometrically superimposed in order to produce the desired structures on the work surface 15.

In regular microstructures 22, the distance A between two adjacent recesses 24 or two adjacent elevations 23 is constant. As a result of this, a regular, uniform pattern of the microstructure 22 along the entire work surface 15 is achieved. It is also possible to provide different microstructures 22 in different sections or regions of the work surface 15. For example, it is possible to provide a different microstructure 22 in the region of the first surface section 15*a* than in the second surface section 15*b*.

Figure 8:
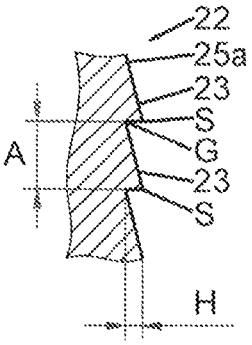
Figure 9:
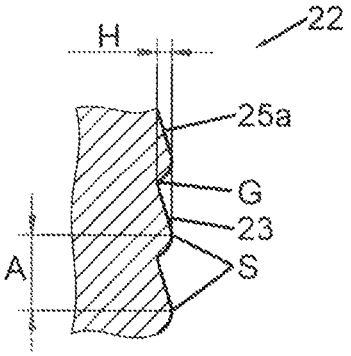

FIGS. 8 to 11 show elevations 23 and recesses 24 that, in accordance with the example, extend closed in the form of a ring around the longitudinal axis L, so that ring-shaped elevations 23 or ring-shaped recesses 24 are formed. As illustrated schematically and in an exemplary manner by FIGS. 8 and 9, the elevations 23 or recesses 24 need not be symmetrical with respect to a radial plane relative to the longitudinal axis L. Starting at a maximum S of an elevation 23, for example, the steepness of the flanks may be different in the opposite direction. Viewed in the direction of movement of the workpiece 11 through the ironing ring 10, the workpiece is only or mainly in contact with the flatter flanks 25*a* increasing to the maximum S, as is schematically illustrated by FIGS. 8 and 9. A sawtooth-shaped microstructure 22, as it were, can be achieved, wherein the edges in the region of the maxima S of the elevations and/or in the region of the minima G of the recesses can be embodied so as to have a sharp edge or be rounded.

Figure 10:
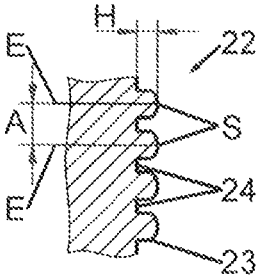
Figure 11:
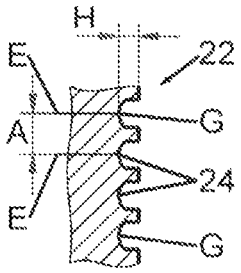

According to FIG. 10, the elevations 23 have a bump-like cross-section and thus form annular ribs. All previously described contours for the elevations 23 can also form—as a negative profile—recesses 24 in the work surface 15 or in the respective surface section 15*a*, 15*b*. FIG. 11 illustrates an example of this. Instead of the ring-shaped rib-like elevations 23 (FIG. 10), it is also possible to form ring-shaped recesses 24 having the appropriate cross-sectional contour.

In modification of the representations of FIGS. 3 to 11, the center axes M or center plane E need not have the same orientation as the normal vector N of the respective surface sections 15*a*, 15*b* or the work surface 15.

The contours of the elevations 23 and recesses 24 described in conjunction with FIGS. 3 to 11 may also be used in any desired combination. Inasmuch as the distance of the work surface 15 from the longitudinal axis L is not consistent due to the inclination of the surface sections 15*a*, 15*b*, the pressure between the workpiece 11 and the work surface 15 increases as the distance of the work surface 15 from the longitudinal axis L decreases. Therefore, it may be advantageous to configure the microstructure 22 in regions of higher pressure differently from regions of lower pressure.

LIST OF REFERENCE SIGNS

10 Ironing ring
11 Workpiece
12 Stamp
13 Ring holder
14 Die
15 Work surface
15*a* First surface section
15*b* Second surface section
16 Interior surface
17 Ironing edge
22 Microstructure
23 Elevation
24 Recess
25 Flank
25*a* Flank with a smaller inclination
A Distance
G Minimum
E Center plane
H Height difference
L Longitudinal axis
M Center axis
N Normal vector
Q Transverse dimension
S Maximum

What is claimed is:

1. An ironing ring (10) for use in a press for ironing pressing a workpiece (11), the ironing ring (10) consists of a metallic material having an interior work surface (15) in operative arrangement with the workpiece (11) and is in contact with the workpiece (11) while the workpiece (11) is being deformed, the interior work surface (15) having a microstructure (22) of predetermined configuration for reducing or avoiding material adhesions to the ironing ring (10) during deformation of the workpiece (11) in the ironing ring (10), the microstructure (22) with elevations (23) and/or recesses (24), wherein the maximum height difference (H) between the elevations (23) and the recesses (24) of the microstructure (22), measured in the direction of a normal vector (N) on the interior work surface (15), is less than 500 nanometers, but greater than zero nanometers.

2. The ironing ring of claim 1, characterized in that the elevations (23) and/or recesses (24) of the microstructure (22) form a uniform pattern or a uniform structure.

3. The ironing ring of claim 1, characterized in that center axes (M) or center planes (E) or maxima (S) of respectively adjacent elevations (23) of the microstructure (22) are at the same distance (A).

4. The ironing ring of claim 3, characterized in that the distance (A) between the center axes (M) or the center planes (E) or the maxima (S) of two adjacent elevations (23) is at most 50 micrometers.

5. The ironing ring of claim 3, characterized in that the distance (A) between the center axes (M) or the center planes (E) or the maxima (S) of two adjacent elevations (23) is less than 1000 nanometers.

6. The ironing ring of claim 3, characterized in the distance (A) between the center axes (M) or the center planes (E) or the maxima (S) of two adjacent elevations (23) is greater than 50 nanometers.

7. The ironing ring of claim 1, characterized in that center axes (M) or center planes (E) or minima (G) of respectively adjacent recesses (24) of the microstructure (22) are at the same distance (A).

8. The ironing ring of claim 7, characterized in that the distance (A) between the center axes (M) or the center planes (E) or the minima (G) of two adjacent recesses (24) is at most 50 micrometers.

9. The ironing ring of claim 7, characterized in that the distance (A) between the center axes (M) or the center planes (E) or the minima (G) of two adjacent recesses (24) is less than 1000 nanometers.

10. The ironing ring of claim 7, characterized in that the distance (A) between the center axes (M) or the center planes (E) or the minima (G) of two adjacent recesses (24) is greater than 50 nanometers.

11. The ironing ring of claim 1, characterized in that the elevations (23) of the microstructure (22) in the direction of a normal vector (N) on the interior work surface (15) are tapered.

12. The ironing ring of claim 1, characterized in that each of the elevations (23) of the microstructure (22), measured transversely to a normal vector (N) on the interior work surface (15), has a transverse dimension (Q) that is less than 20 micrometers.

13. The ironing ring of claim 12, characterized in that each of the elevations (23) of the microstructure (22), measured transversely to the normal vector (N) on the interior work surface (15), has a transverse dimension (Q) that is less than 1000 nanometers.

14. The ironing ring of claim 1, characterized in that the interior work surface (15) has two surface sections (15*a*, 15*b*) that subtend an angle.

15. The ironing ring of claim 1, characterized in that at least the interior work surface (15) of the ironing ring (10) consists of a harder material than the material of the workpiece (11) that is to be deformed.

16. The ironing ring of claim 1, characterized in that the interior work surface (15) is not coated.

* * * * *